US010829300B1

(12) United States Patent
Via

(10) Patent No.: US 10,829,300 B1
(45) Date of Patent: Nov. 10, 2020

(54) RUBBISH BIN BLIND COVER

(71) Applicant: Stephen D. Via, Covington, VA (US)

(72) Inventor: Stephen D. Via, Covington, VA (US)

( * ) Notice: Subject to any disclaimer, the term of this patent is extended or adjusted under 35 U.S.C. 154(b) by 0 days.

(21) Appl. No.: 16/039,217

(22) Filed: Jul. 18, 2018

(51) Int. Cl.
*B65F 1/14* (2006.01)
*B65F 1/16* (2006.01)

(52) U.S. Cl.
CPC ..... *B65F 1/1426* (2013.01); *B65F 1/1615* (2013.01); *B65F 1/1646* (2013.01); *B65F 2210/148* (2013.01)

(58) Field of Classification Search
CPC ..... B65D 90/06; B65D 21/086; B65D 29/00; B65F 2220/106
See application file for complete search history.

(56) References Cited

U.S. PATENT DOCUMENTS 6,286,461 B1 * 9/2001 Martz ..... A01K 1/0254 119/497
7,578,511 B2 8/2009 Sheehan
2008/0056625 A1 * 3/2008 Stanton ..... B65F 1/0006 383/104
2012/0055597 A1 3/2012 Aznar-Meyer et al.
2020/0002087 A1 * 1/2020 Lee ..... B65F 1/06

FOREIGN PATENT DOCUMENTS

GB 2483302 A 7/2013

* cited by examiner

*Primary Examiner* — Shawn M Braden
(74) *Attorney, Agent, or Firm* — Mary-Jacq Holroyd; Johnston & Holroyd

(57) ABSTRACT

A rubbish bin blind cover 12 used to hide a wheeled W rubbish bin G, that has a handle H and a lid L, from sight until rubbish or recyclables collection day. A blind cover body 14 having a hollow cylindrical form with a top periphery, fasteners, straps, and a wire frame, with a blind cover lid 30 which is the diameter of the cylinder. The blind cover lid 30 is attacked by fasteners, and straps that criss-cross with a wire frame that holds the lid L of a trashcan when opening or closing.

19 Claims, 17 Drawing Sheets

RUBBISH BIN BLIND COVER

COPYRIGHT NOTICE

A portion of the disclosure of this patent document may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

Wheeled rubbish bins G with handles H are well known and are found everywhere on the side of the road or adjacent buildings. These rubbish bins G are setting in view at homes, and businesses, everywhere, and come in a variety of volumes and sizes. Most are provided by the garbage pickup companies or local governments to each household or business that they serve. Rubbish bins and similar recycling bins may be around the same size and volume, and when reference is made to rubbish bins herein, recycling bins are included.

These bins are left by the road for collection every week, or twice a month. The bins are kept at the home (or business) during the remainder of the time. The bins are stored outside against the house, in the yard, on the porch, or in the garage. Ordinances in some communities require that the bins be stored out of sight except during garbage pickup days. An example of such a rubbish bin is shown in U.S. Pat. No. 5,088,750, which is a waste container that has wheels and a lid, and is rolled to the curb for collection. US Design Pat. No. D416367 is for a similar but smaller wheeled trash container. US Design Pat. No. D532173 shows a waste container with a handle, wheels, and a lid.

To obscure view of these unsightly rubbish bins, many building owners provide areas that have fences or walls obscuring the view of their building's unsightly rubbish bins. Not everyone can build a fence, or box, to house these large bins. There exists a need to develop a rubbish bin blind cover to hide individual rubbish bins.

Efforts have been made to hide rubbish bins in the past. The UK Patent No. GB 2483302 describes a storage housing for a waste receptacle which has a bin enclosure with opening door and opening lid. The storage housing is a wood structure that doesn't allow the rubbish bin to be easily moved while still in the housing.

US Patent Application No. 2012/0055597 A1 provides a waste receptacle cover that is used to cover the receptacle in a decorative or whimsical fashion that attaches closely to the waste receptacle. The receptacle cover does not hide the entire waste receptacle but instead decorates the mid-section with a protective layer of weather/wear resistant material. The receptacle cover is composed of material that is weather resistant and can have a decoration screen-printed or otherwise disposed on the material to decorate the waste receptacle. Furthermore, straps are used to hold the waste receptacle cover in place while the waste receptacle lid is closed.

U.S. Pat. No. 7,578,511 B2 teaches a four-wheeled wagon-like trash bin. The trash bin has decorative panels and detachable cart. This is a larger type of trash receptacle used for larger multi-tenant apartment buildings or business buildings. The decorative panels may include building designs such as brick, rock wall, and the like.

US 707906 TO 08 ARE TRASH CONTAINERS

There remains a need for concealing a wheeled rubbish bin, or a recycle bin, with a handle, or a handle and wheels, for homes or businesses where they are set through the week. These types of rubbish or recycle bins are typically rolled to and from the road for trash or recyclable collections, and are emptied either via an automated truck arm, or a worker. A rubbish cover or blind is needed to hide the bins in place.

SUMMARY OF THE INVENTION

The present invention is a rubbish bin blind cover 12 which is used to hide a conventional wheeled W rubbish bin G, or similar recycle bin, each of which typically has a handle H and a lid L, from sight until rubbish or recyclables collection day. The rubbish bin blind cover 12 is either placed upon the ground, and the rubbish bin G is rolled into the center of the blind cover, which is then lifted and fixed into place relative the rubbish bin's lid L. Alternatively, the rubbish bin blind cover 12 is lifted and centered overtop of the rubbish bin G. The bottom and sides of the rubbish bin blind cover G are let go so that the bottom 22 falls upon the ground while still holding onto the top 25 of the rubbish bin blind body 14 and lid 30.

When the rubbish bin G is inside of the rubbish bin blind cover 12, the connecting straps 32, fasteners 20, 36, and 38, tabs 60, and wires 16 to hide the bin from sight. Everything used to make the rubbish blind cover 12 needs to be resistant to harsh weather conditions.

Once the rubbish bin blind cover body's 14 top perimeter 25 is held in place adjacent the handle H and front lip of the rubbish bin G, then it can be secured using the front strap 46 attached to a hook 76 and backside straps 42 and 44. Next are the straps 32, that are stitched into the rubbish bin lid 30 forming stitches 18, crisscross and connect on opposite sides of the rubbish blind lid 30 perimeter of the collapsible cylindrical structure 15 after going over the bottom side middle of the rubbish bin lid L. Lastly, finish with all the fasteners 20, 38, 36 on the perimeters of the rubbish blind 12 and rubbish blind lid 30 to enclose the rubbish bin G from sight, and thereby allowing the rubbish bin G encased in the blind cover 12 to be out anywhere on the property until trash day without the offensive appearance. The rubbish blind cover 12 is easily removed to avoid damage when emptied via the truck's mechanical dump arm, or a trash removal worker, when taken to the road.

The rubbish bin blind cover 12 will preferably be composed of materials, threads, fasteners, straps, and wire coating to address the needs for the materials to withstand harsh weather conditions of temperature, UV rays, and/or be mildew resistant. Using wire 16 and materials that are coated, painted, or otherwise treated are desirable. All weather materials will make the rubbish bin blind covers long lasting, and easier to clean.

Alternative embodiments of the present invention, the rubbish bin blind cover 12 can come in mixed or matched fabric of multiple colors, patterns, and can be printed with an image or logo, using ink or a digital print.

Additionally, the rubbish blind cover 12 (when collapsed flat) may be twisted into a figure eight and folded together for shipping, shelf display, and storage. Once the rubbish bin blind cover 12 is twisted and folded together, is only a couple of feet across.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figures 1A, 1B:
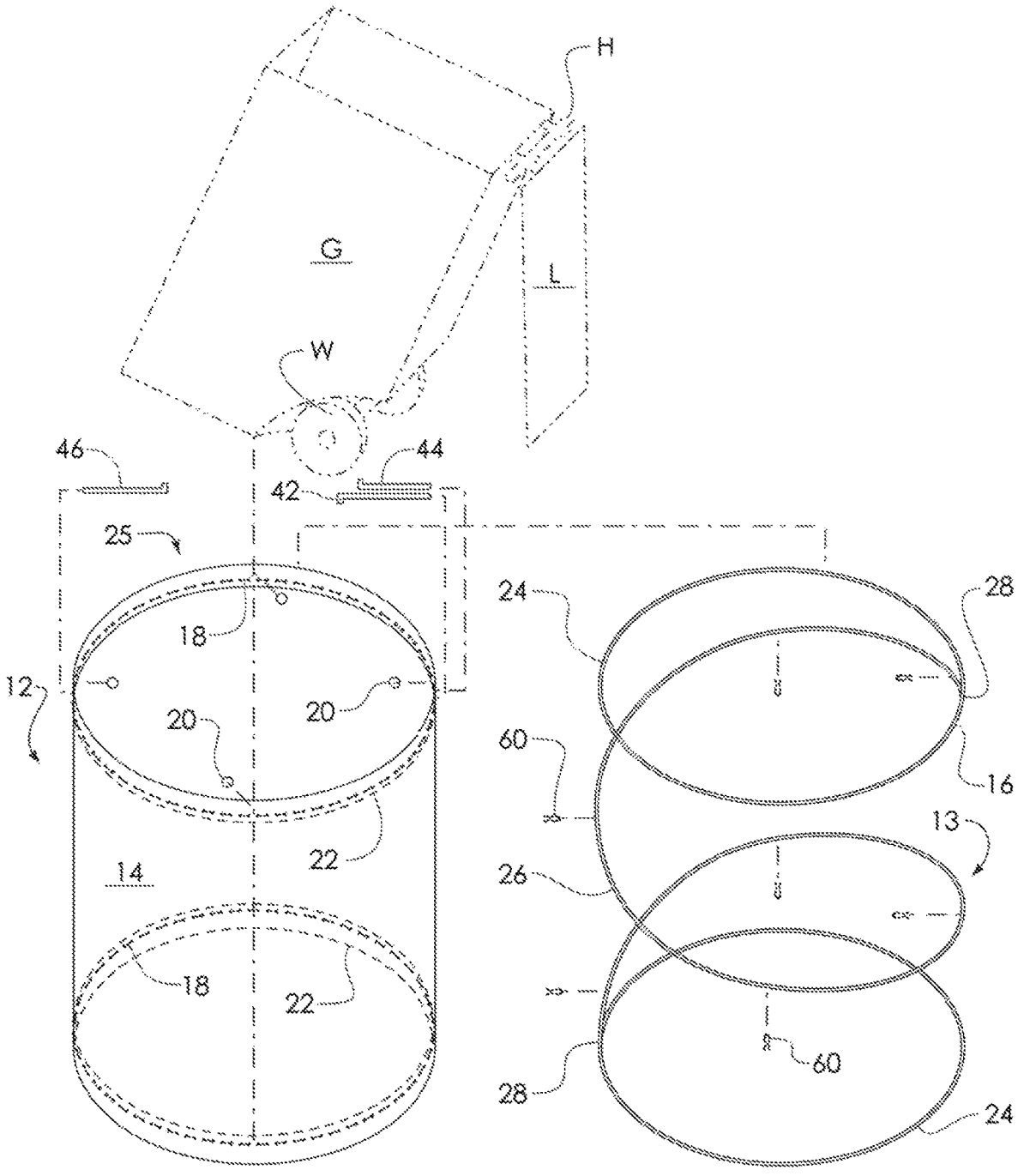
FIGS. 1A-1C combined represent exploded views of the rubbish bin blind cover 12 and lid 30 according to alternative embodiments of the present design.
Figure 1C:
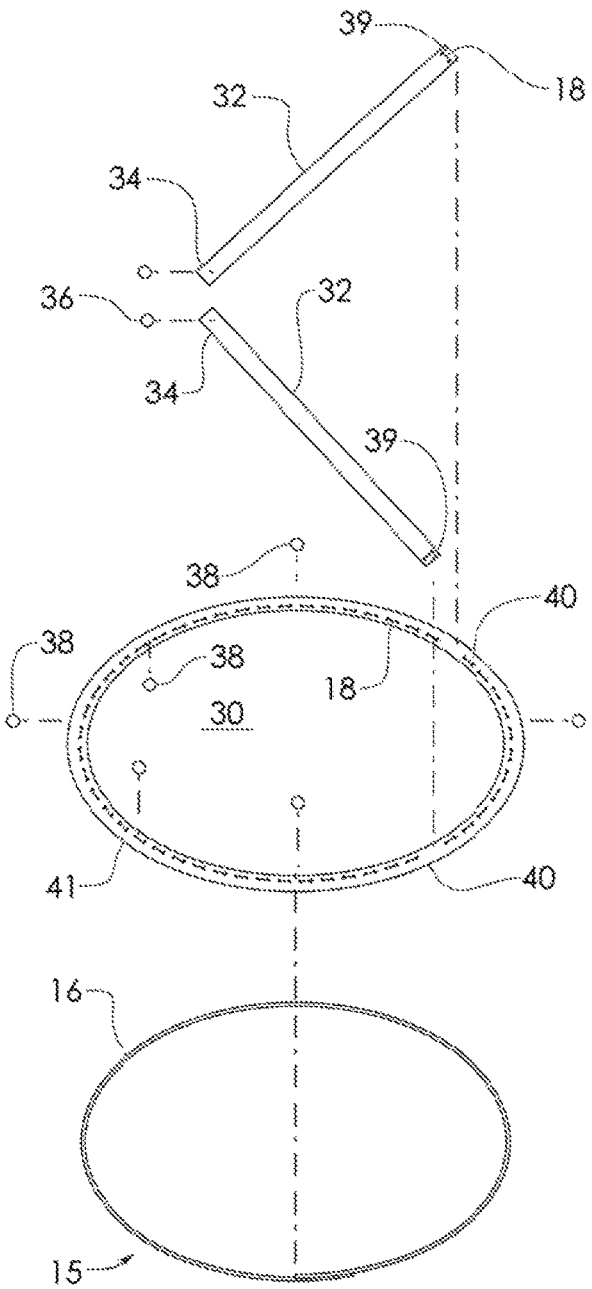

FIGS. 1A-1C combined represent exploded views of the rubbish bin blind cover 12, according to alternative embodiments of the present design, including the blind body 14 in FIG. 1A, the wire 16 in FIG. 1B which foams the collapsible cylindrical infrastructure 13 of the blind cover 12, and the lid 30 in FIG. 1C which includes wire 16 to provide a circular infrastructure 15 for the lid 30. Individual aspects 25 of the blind cover 12 are shown, which includes wires 16, stitches 18, fastener sites 20, straps 32, and the like. The attachment to the blind 14 and the blind's lid 30 once a rubbish bin G is placed inside and secured to the rubbish blind cover 12 and the lid is closed 30, the rubbish bin G is completely hidden from view. The blind's lid 30 is attached to the blind 14 unless for storage, cleaning, shipping, or the like. A wheeled rubbish bin G with its rubbish bin lid L are shown in FIG. 1A with the rubbish bin lid L open. In addition to the rubbish bin lid L, the rubbish bin G has two wheels W and a handle H. FIG. 1B shows the wire 16 configuration which provides structure to the blind 14. FIG. 1C shows the lid 30 and its attachments to the blind cover 12. The straps 32, have front 34 and backs 39, in which the straps 32 are stitched 18 to the lid at 40. The straps attached at the front 34 by fasteners 36 and 38, as shown at 41 for one of the straps 32.

The rubbish bin blind cover 12 with the blind body 14 and the wire 16 in place forms the collapsible cylindrical structure 13 with a blind cover lid 30 also with a wire 16 for structure 15. When in use, the rubbish bin blind cover 12 is held up and supported via the rubbish bin G. Two straps 42 and 44 hook together once one goes around the handle on the backside, and a strap 46 on the front with a fastener that hooks 76 onto the top lip of the rubbish bin G. The two straps 42 and 44 may be of unequal lengths to ease attachment to prevent breakage. The spiraling coated wire 16 has a top and bottom loops 24 and a diagonal 26 length to be placed within the blind cover body 14 between top and bottom circles 22, so that the wire 16 is continuous throughout the blind cover body 14. The wire 16 may be coated, and is pushed into the blind cover body 14 at the point corresponding to bend 28 on the wire 16. The wire 16 fits in the channel through the diagonal length 26 and is retained in place by the tabs 60 or functionally equivalent retainer. That is, the wire 16 goes into the bend 28 with a little extra past the bend 28 then the wire 16 continues through each tab 60 channeling until going through bend 28 on the opposite end of the blind cover body 14 on opposite side and again fed past the insert.

Figure 2A:
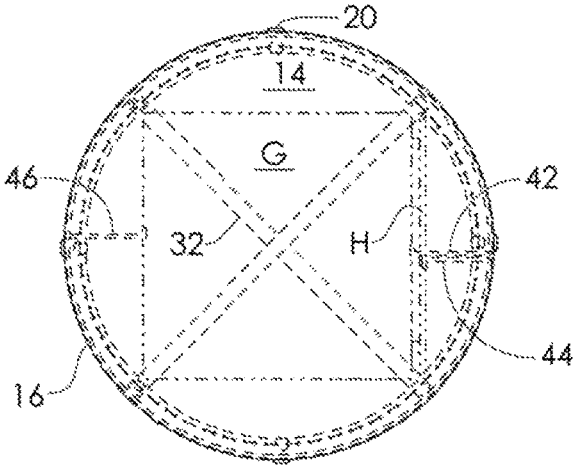
FIGS. 2A-2C are views of the rubbish bin blind cover 12 and lid 30 from the bottom and top showing the rubbish bin blind cover 12 with the rubbish bin G placed in the rubbish bin blind cover 12 with the lid 30.
Figure 2B:
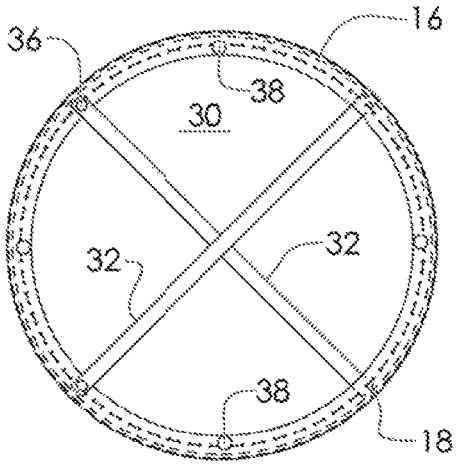
Figure 2C:
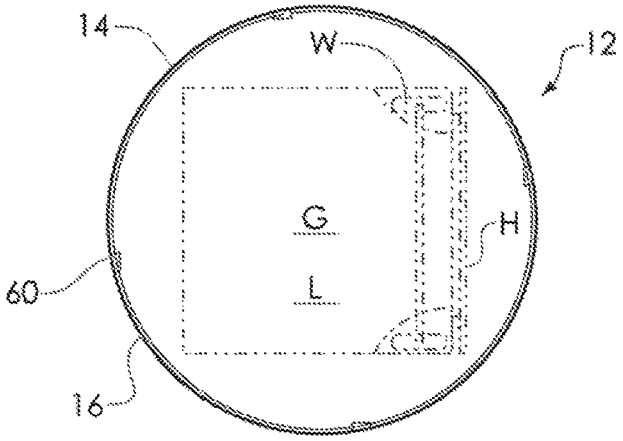

FIGS. 2A-2C are views of the rubbish bin blind cover 12 from the bottom and top showing the rubbish bin blind cover 12 with the rubbish bin G placed in the rubbish bin blind body 14 and of the blind cover lid 30. FIGS. 2A and 2C show the bottom and top views of the rubbish blind cover 12 with the rubbish bin G inside. FIG. 2B shows the opened inside view of the rubbish blind lid 30 showing where the corresponding fasteners 38 and 36, straps 32, stitches 18, and wire 16 are in conjunction of each other. The rubbish blind cover lid 30 and the rubbish bin lid L are held together by crisscrossing straps 32, and then close blind cover lid 30 on top of the rubbish bin G. The blind cover lid 30 has substantially the same circumference as cylindrical blind 14 and the wire 16 within the cylindrical blind 14. The lid 30 and in the perimeter of the top of the rubbish bin aligned cover cylinder 14 has an opening or attachments in each ⅛ section, such that they are evenly distributed around the peripheral of the lid 30 and the top of the cylinder 14. The corresponding fasteners 20 and 38, line up, as shown, to attach the blind body 14 to the blind cover lid 30, once the straps 32 are connected over top of the blind cover lid 30 with corresponding fasteners 36 and 38 attached, respectively. Where permanent attachment is appropriate, stitches 18 may be used to secure features together. For example, the straps 32 are attached to the blind cover lid 30 at one end of each strap 32 in between the fasteners 38, on each side of the fastener 38 roughly in between that fastener and that connects to body 14 and fastener 20 where the nest straps 42 and 44 connect straps 42 and 44. This is where straps 32 are sewn at the time stich 18 as sewn. The rubbish blind cover 12 has corresponding connection sites or fasteners 20 and 38 on the top of the rubbish blind body 14 and along the periphery of the blind cover lid 30. These fastener sites 20 and 38 are equal distance on quarter sections of the top periphery of the periphery of the rubbish blind lid 30 with the corresponding features in the rubbish blind body 14. The blind 14 is attached to the rubbish bin G by holder 46.

The fasteners 38 on the rubbish blind lid L are connected to corresponding fasteners 20 on the rubbish blind body 14 such that when the lid 30 is shut the rubbish bin G is out of sight. The fasteners that connect the rubbish blind body 14 to the rubbish blind lid 30 are then secured together by being snapped, looped, buckled, hooked, or otherwise affixed. Optional fasteners 20, 36, 38, 42, 44 and 46 include hooks 76, loops 64, ties 70, hook and loop strips 68 and 69, buttons 62, snaps 90 and 92, screws 114, O-rings 120, cinch buckle 130, magnets 100, snapping buckles 104 and 106, hook 68 and loop 64, zippers 98, magnets 100, knot 67 and loop 64, quick link 82 and strap loop 78, snap hook 80 (aka carabiner) and D-ring 86, hook-eye closures 76 and 102, lobster clasp 84, hook 68 and snap clasps 94 and 96, hole 88 and button 62, button 62 and loop 64, toggle button 118, pressure clasps 122 and 124, spring clasp 84, mating clasps 72 and 74, or combinations thereof, or the like. Sturdier fasteners, include cinch buckle 65 and 66, key snapping buckles 108 and 110, open snapping buckles 112 and 110, hook 76 and D-rings 86, may be desirable to accommodate the motion of the rubbish blind cover lid 30 and the rubbish bin lid L attached to the cylindrical blind 14. Fasteners may require material backing so as to be sewn into the seams on the perimeters. These backings can be made up of nylon, elastic, polyethene, woven cord, or polyester. A hook may be used to attach the blind cover lid 30 to the front of the rubbish bin lid L to hold it in place while attaching fasteners. All fasteners are depicted as simple circles in the FIGS. 1 through 14. These circles represent any kind of appropriate fastener, including but not limited to, those fasteners disclosed in FIGS. 15 through 42.

Figure 3:
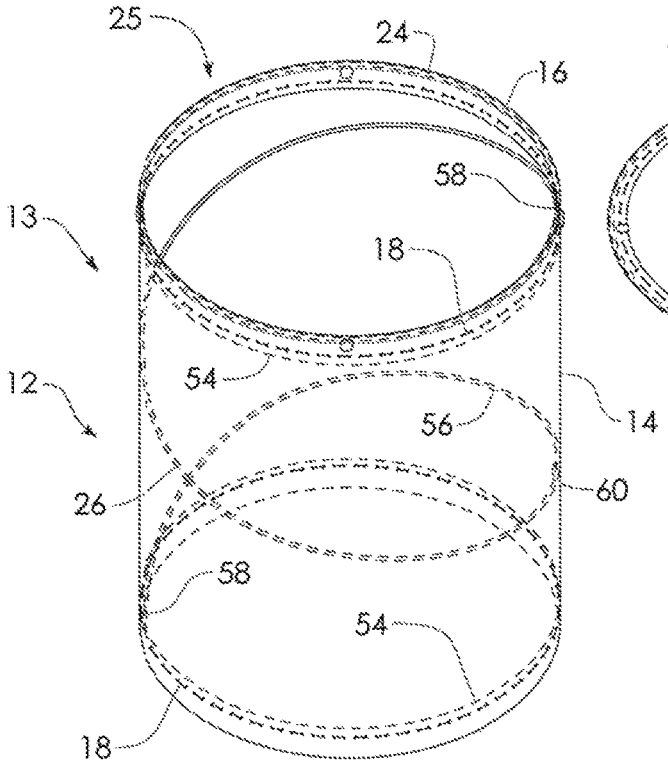
FIG. 3 shows the placement of wire 16 throughout the rubbish bin blind cover 12 according to embodiments of the present design.
Figure 3:
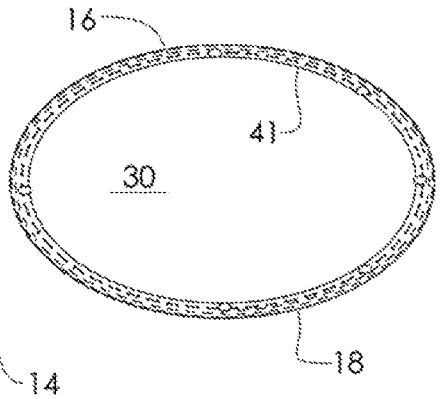

FIG. 3 shows the placement of the wire 16 throughout the rubbish bin blind cover 12 according to embodiments of the present design. In order to hold the wire 16, wire tabs 60 are stitched on a spiral pattern on quarter sections of the rubbish blind body. A channel 56 may be provided on the inside of the blind cover body 14 to accommodate the wire 16 that forms the cylindrical infrastructure 13. A diagonal channel 56 and/or a series of tabs 60 sewn into the blind cover body 14 to accommodate the diagonal part 26 of the wire 16, and the perimeter wire sections 24 which fit in the perimeter channels 54. Alternatively, the channel features 54 and 56 may be a double layered section of blind body 14 material in which the wire 16 is fed through the channels 54 and 56. The blind cover lid 30 also has a channel 41 for receiving the wire 16 therethrough. Alternatively, the blind cover lid 30 may have ties for tying the wire 16 into place, or stitching 18 to make a channel to secure the wire 16 in place, or combinations thereof.

The wire 16 travels through a channel 56, shown in FIG. 3, at the top and bottom periphery 54, and is fed through a gap 58 corresponding to the wire 16 where it bends from the round periphery 24 to the diagonal section 26. Tabs 60 that are placed on the inside of the rubbish blind body 14 form the channel 56, and are shown disconnected in FIG. 1B to demonstrate where along the length of the wire 16 that the tabs 60 are disposed. A wire 16 also goes through the perimeter channel 41 of the rubbish blind lid 30, as well.

Figure 4:
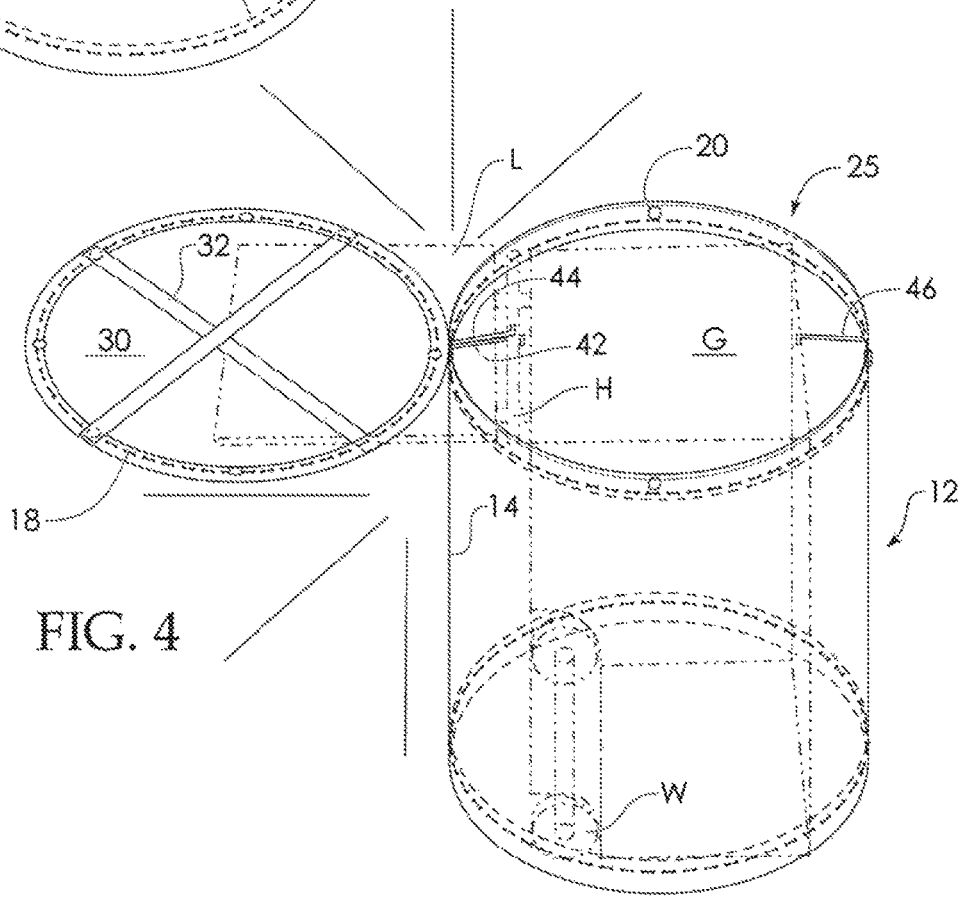
FIG. 4 shows the rubbish bin blind cover lid 30 position when the rubbish bin lid L is opened halfway.

FIG. 4 shows the rubbish bin blind cover lid 30 position when the rubbish bin lid L is halfway open. The lid L is shown going from a closed position on top of the rubbish bin to being completely opened hanging downward and placed against the side of the rubbish bin G. The blind cover lid 30 is secured by the crisscrossing straps 32 over the inside of the rubbish bin lid L.

Both the rubbish bin lid L and the rubbish bin blind cover lid 30 to be opened and closed at the same time when depositing rubbish into the rubbish bin G, or when putting the blind cover 12 on or taking the blind cover 12 off. The rubbish blind cover 12 is removed for trash day and during very harsh weather conditions.

Figure 5:
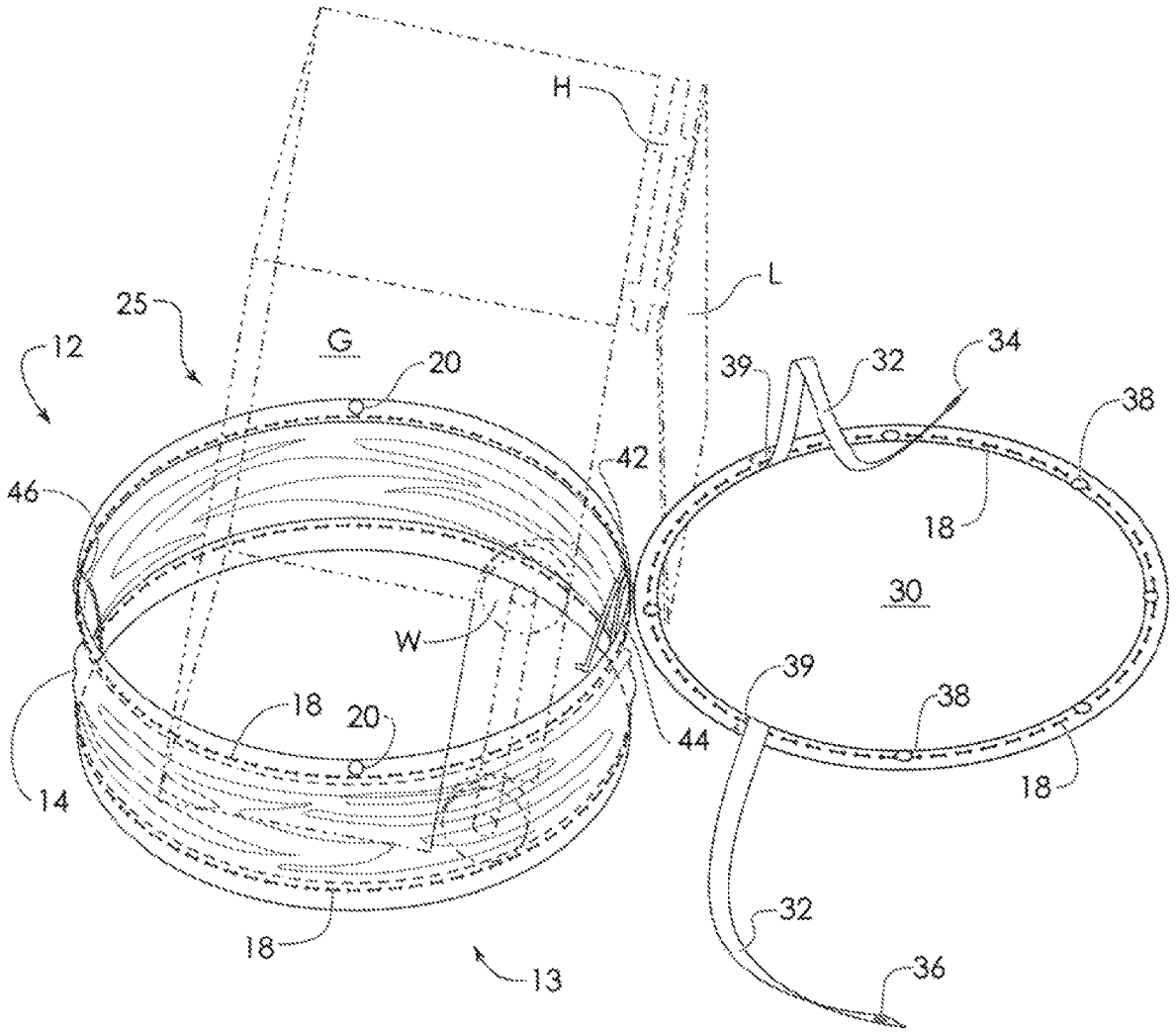
FIG. 5 shows the rubbish bin blind cover 12 collapsed with the lid 30 open and the straps 32 unlatched with the rubbish bin G placed inside the collapsed cover 12.

FIG. 5 shows the rubbish bin blind cover 12 collapsed with the blind cover lid L open and the straps 32 unlatched from fasteners 38 with the rubbish bin G placed inside the collapsed blind cover 12. This is the position to either remove the rubbish bin blind cover 12 or to begin pull blind body 14 up around the rubbish bin G. To effect this, the rubbish bin G is tilted back using the handle H, and then it is rolled upon its wheels W. The rubbish bin G can be pulled, pushed, or lifted over top of the collapsed rubbish blind cover 12 so it can be taken to the road for collection with the blind cover 12 off or left in the yard after collection with blind cover 12 on. One way to put the rubbish bin blind cover over the rubbish bin is to place the rubbish bin blind cover 12 on the ground with the lid opened, and place the rubbish bin in the middle of the rubbish blind cover, as shown in FIG. 5. The three straps 42, 44, and 46 extend from the blind cover 12, which is from perimeter 25 and hooks to the rubbish bin G to help hold up the blind cover 12, and helps to hold up blind body 14, while attached by the fasteners 20 to 38. The rubbish bin lid L may retain the blind cover lid 30 because the blind body 14 can be separated from the blind cover lid 30 beforehand.

Figure 6:
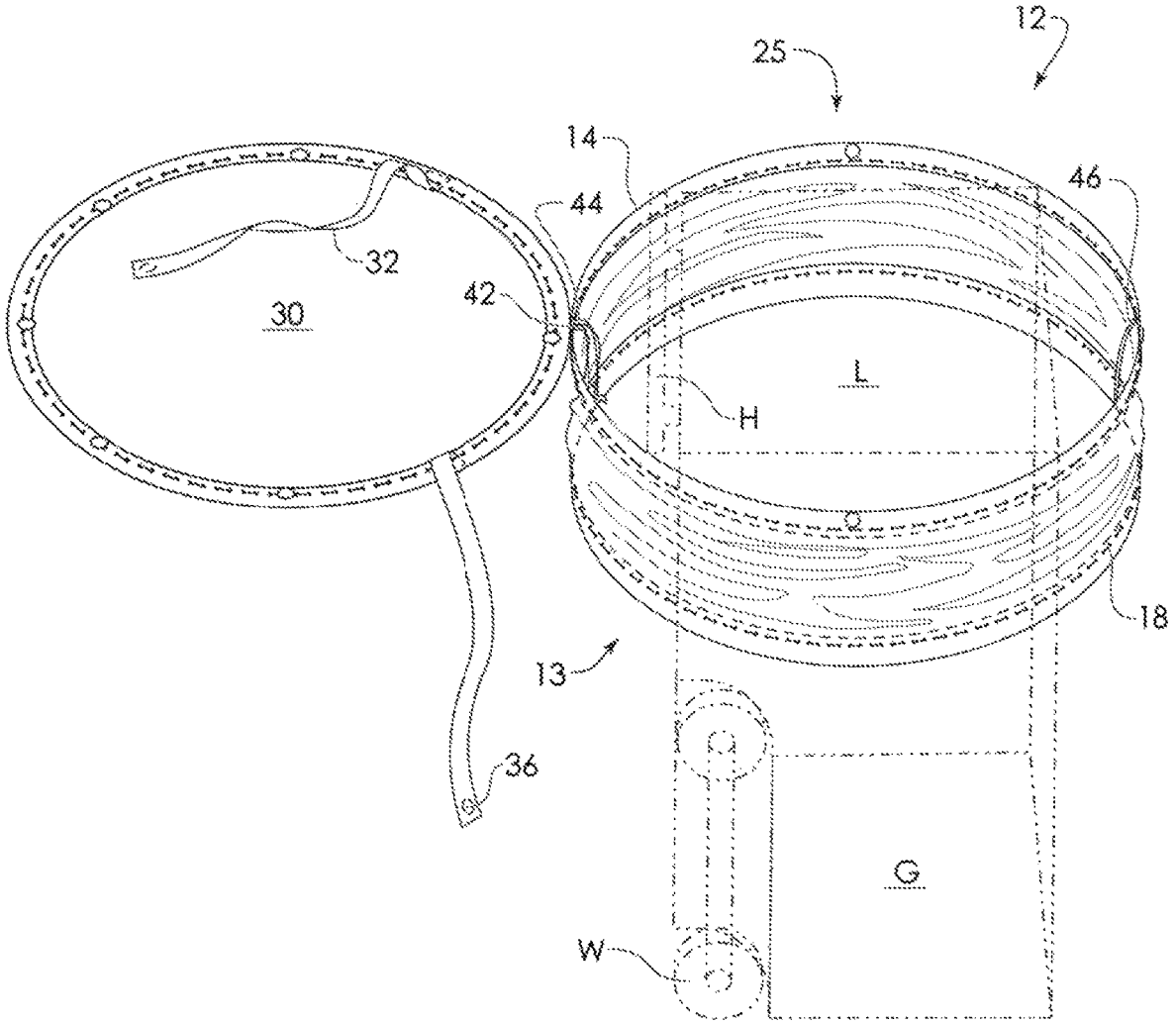
FIG. 6 shows the rubbish bin blind cover 12 placed over the rubbish bin G collapsed and held up at the top with the lid 30 halfway opened and the straps 32 unlatched.

FIG. 6 shows the rubbish bin blind cover 12 collapsed with the blind cover lid 30 closed and the straps 32 unlatched with the collapsed blind body 14 of the blind cover 12 centered over the rubbish bin G. When the bottom half is let go, the blind body 14 forms into the cylindrical shape supported by the wire 16. When removing the blind cover 12, the blind cover 12 may be bunched up from the ground around the rubbish bin G, and lifted up and over to remove. Taking the rubbish blind cover 12 off this way can be done because of personal preference or during bad weather conditions, that could result in the rubbish blind cover 12 getting filthy if ran over via the wheels W. The rubbish blind cover 12 (when collapsed flat) may be twisted into a figure eight and folded together for shipping, shelf display, and storage. Once the rubbish bin blind cover 12 is twisted into a figure eight and then folded together, it is only a couple of feet across FIGS. 7A-7E are views of alternative embodiments of the rubbish bin blind body 14 with one to four sections of material before the ends are hemmed into a cylinder and where the tabs 60 are disposed. They are either vertically or diagonal cut one to four pieces of material before the ends are hemmed into a cylinder. The hems are depicted as stitches 18. Fasteners 20, and straps 42, 44, 46 are sewn at the same time as the stitch 18 is done at the top. These figures show where the hem would be, and a what places the tabs are stitched into the hems/seems, or onto the rubbish blind material. Where four pieces are used in a vertical cut, the tabs 60 are disposed in the seams between sections as shown.

Figure 7A:
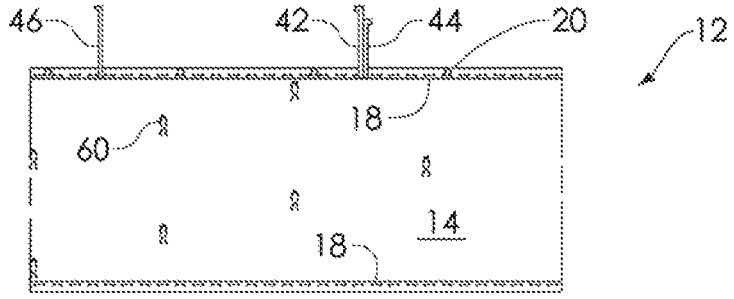
FIGS. 7A-7E are views of alternative embodiments of the rubbish bin blind cover body 14 in either a vertical or diagonal cut of one to four pieces of material before the ends are hemmed into a cylinder and where the tabs 60 are disposed.
Figure 7B:
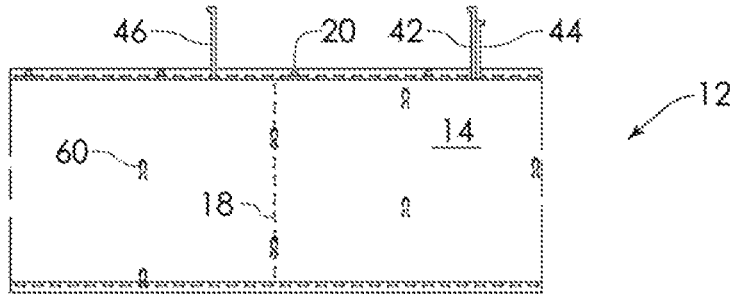
Figure 7C:
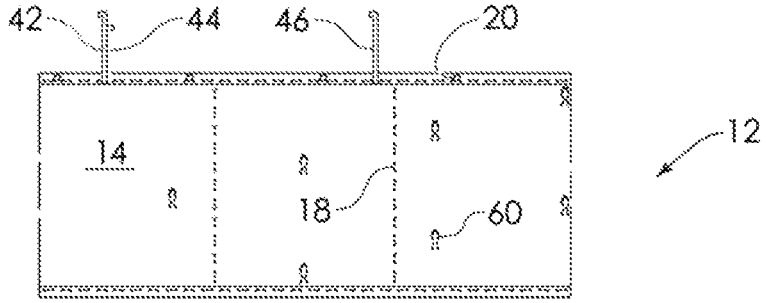
Figure 7D:
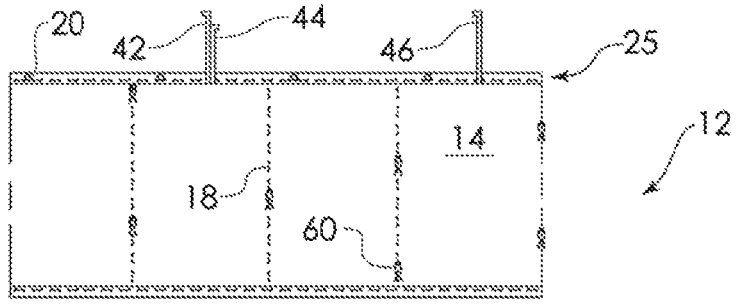
Figure 7E:
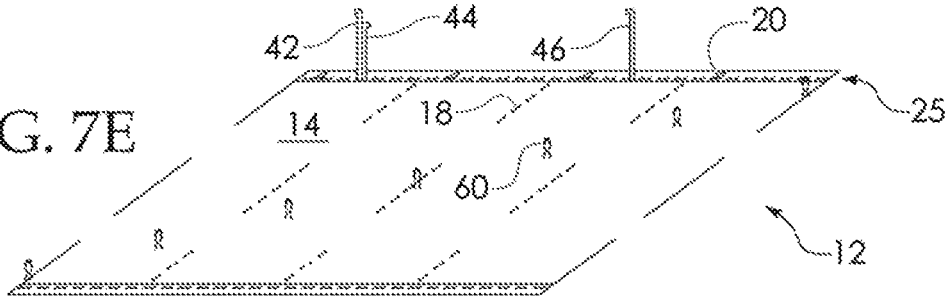

FIG. 7A shows a rubbish blind body 14 which composes a single sheet of material cut along the vertical. FIG. 7B shows a rubbish blind body 14 which is composed of two vertically cut sheets of material with the tabs 60 as indicated. FIG. 7C shows a rubbish blind body 14 which has three vertical cut sections, and FIG. 7D has four. FIG. 7E demonstrates a diagonally cut four parallelogram panel sections resulting in an alternative embodiment in which the tabs 60 are disposed in a straight diagonal line between two opposing corners, as shown, but not all of them in the stitching 18 diagonal cuts.

The tabs 60 need one twist, or to be made into a loop, before being stitched. Tabs 60 are stitched in at quarter sections of the blind body 14 using a stitch 18 to attach it. Alternate channel 56 follows the path of the tabs 60. The placement of the tabs 60 and channel 56 is carefully selected to avoid the fasteners and straps on the top periphery of the blind body 14. The path of the channel 56, which the wire 16 follows when held in place by the tabs 60, is shown in FIG. 3.

Figure 8:
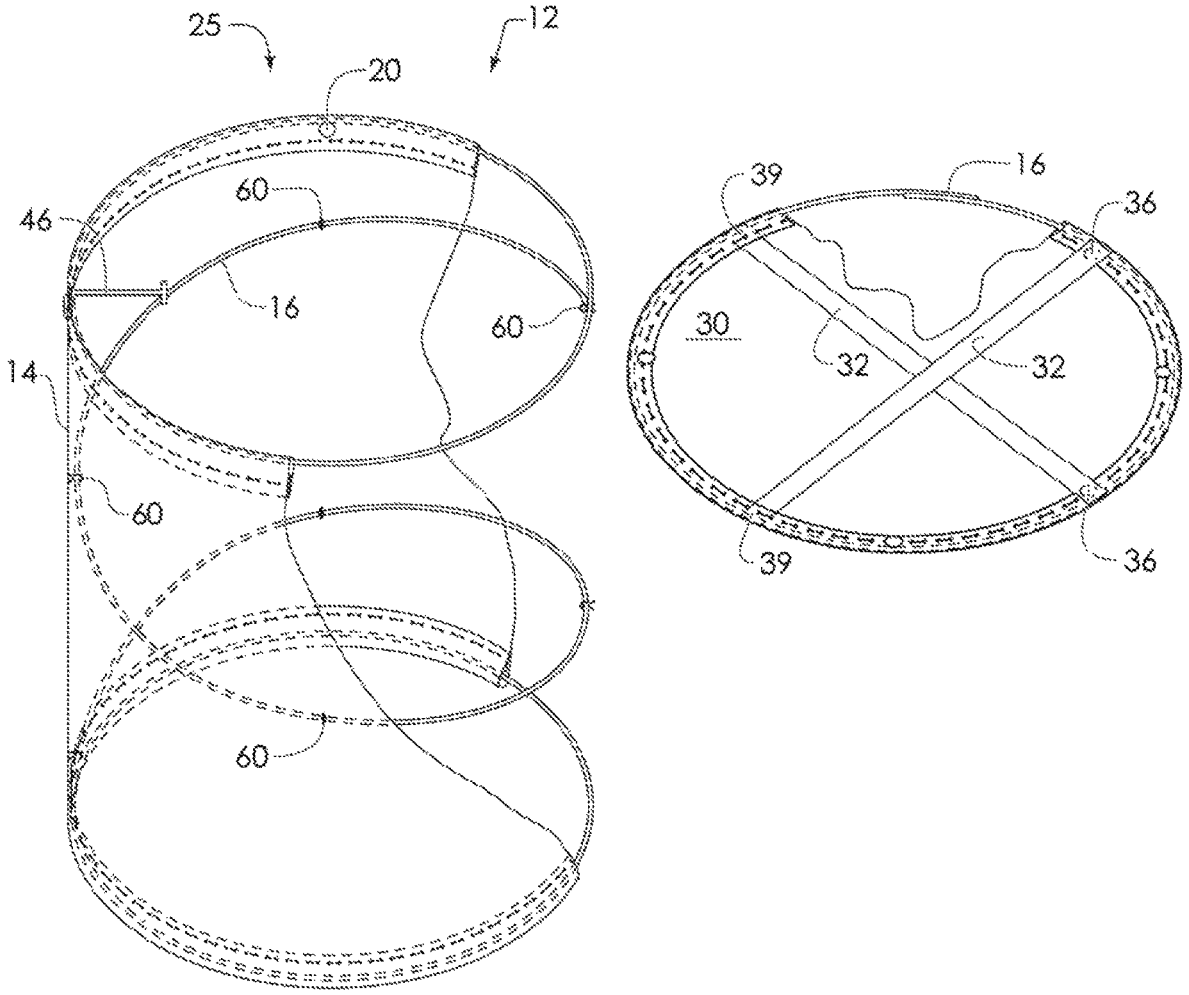
FIG. 8 is an elevated view of the rubbish bin blind cover 12 showing the placement of straps 32, tabs 60, and wires 16, and where the fasteners 20, 36, 38 connect to each other.

FIG. 8 is an elevated view of the rubbish bin blind cover 12 showing the interior of the blind cover body 14. More specifically, the location of wires 16 are shown. The blind cover lid 30 is shown with the straps 32 fastened in place.

Figure 9:
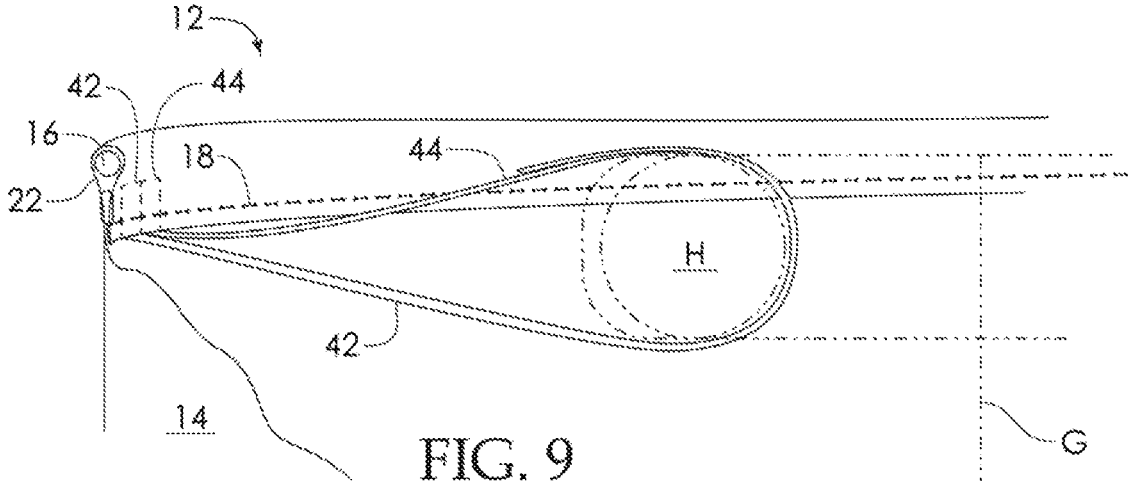
FIG. 9 is a partial cutaway side view of the rubbish bin blind cover 12 showing where straps 42 and 44 are attached by stitching 18 which in turn the straps 42 and 44 connect after one goes around the handle H of a rubbish bin G.

FIG. 9 is a partial cutaway side view of a rubbish bin blind cover 12 showing where the blind cover 12 is attached to the handle H of a rubbish bin G. As shown, a longer strap 42 and a shorter strap 44 may be provided so that the fastener 42 or 44 is not opposite the blind cover body 14 or handle H to reduce forces on the fastener 42 or 44.

Figure 10:
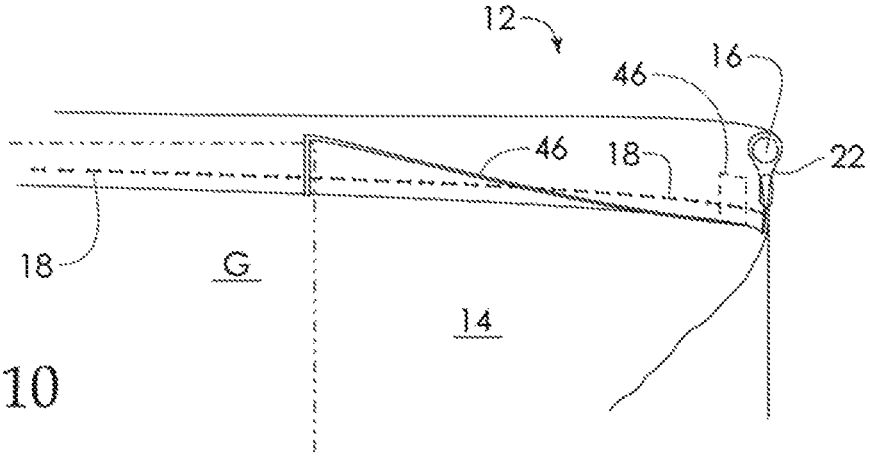
FIG. 10 is a cutaway view of hem stitching 18 for a rubbish bin blind cover body 14.

FIG. 10 is a cutaway view of a hem of a rubbish bin blind body 14 that shows where the fasteners 46 are sewn into stitch 18. Furthermore, the location of the wire 16 traversing through the hem is shown.

Figure 11A:
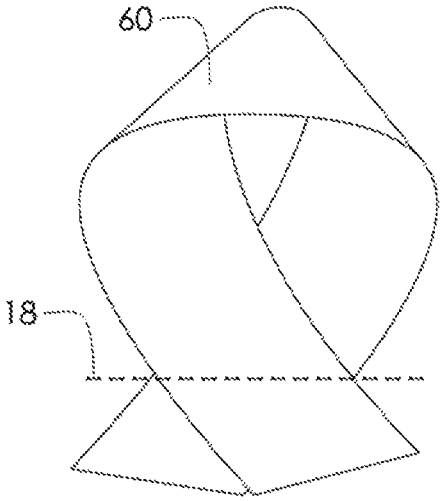
FIGS. 11A and 11B shows the stitching 18 of the tabs 60 once one twist in the fabric.
Figure 11B:
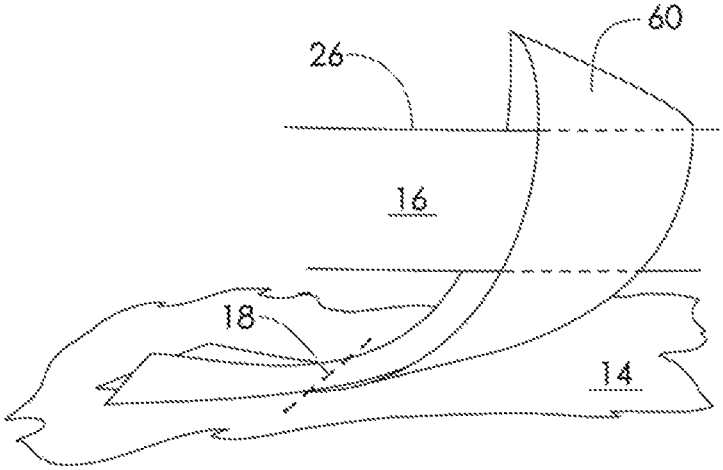

FIGS. 11A and 11B show the stitching 18 of the tabs 60, shown in FIGS. 7A-7E, once one twist in the fabric. As discussed previously, FIG. 1.B shows where the tabs 60 are relative to the wire 16 which they retain in place to provide the structure of the blind 14. The nature of the configuration of the twist for the tabs 60 is shown FIG. 11A, with stitching 18 across the tabs 60. FIG. 11B shows the tabs 60 as stitched into the blind body 14.

Figure 12A:
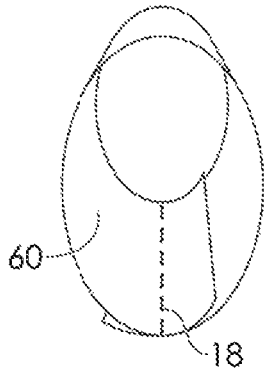
FIGS. 12A and 12B are long and side views of alternatives of the tabs 60 showing the diagonal 26 and stitches 18 relative thereto on the blind body 14.
Figure 12B:
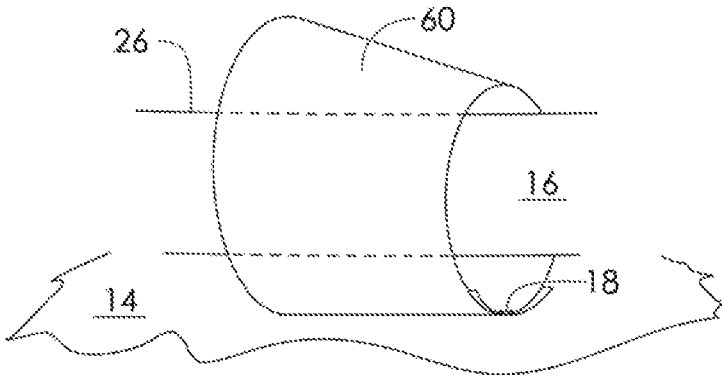

FIGS. 12A and 12B are long views and side views of the diagonal part 26 and stitches 18 relative thereto on the blind body IA. FIG. 12A just shows the stitching 18. FIG. 12B shows the diagonal 26 as seen in FIG. 11B.

Figure 13A:
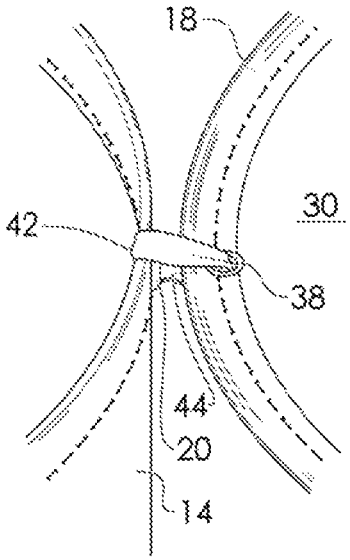
FIGS. 13A, 13B, and 13C are partial elevated views of the attachment between lid 30 and blind 14 showing the attachment therebetween in a halfway open position and in a closed position, and the attachment between the rubbish bin G and the blind 14.
Figure 13B:
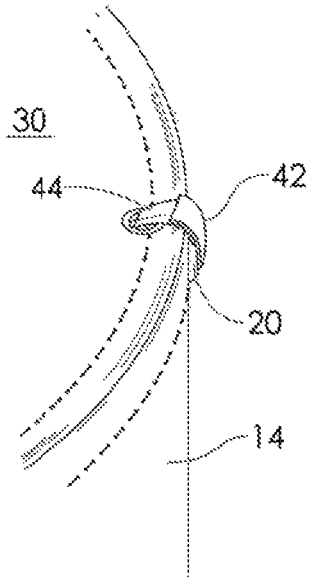
Figure 13C:
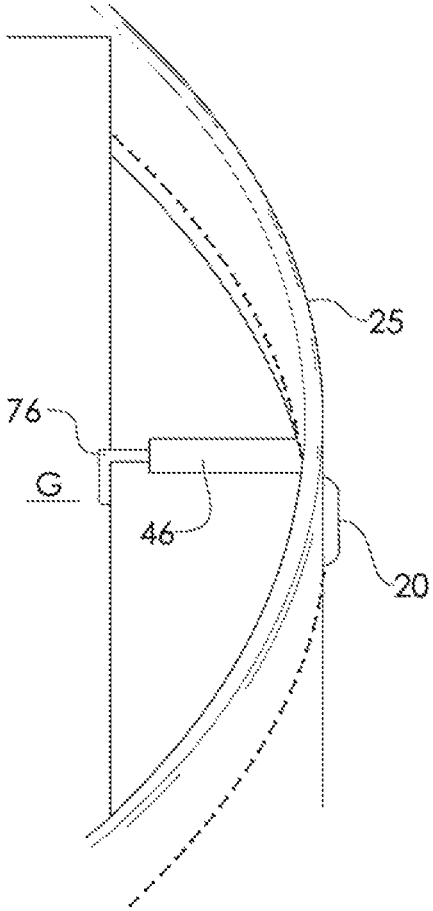
Figure 14:
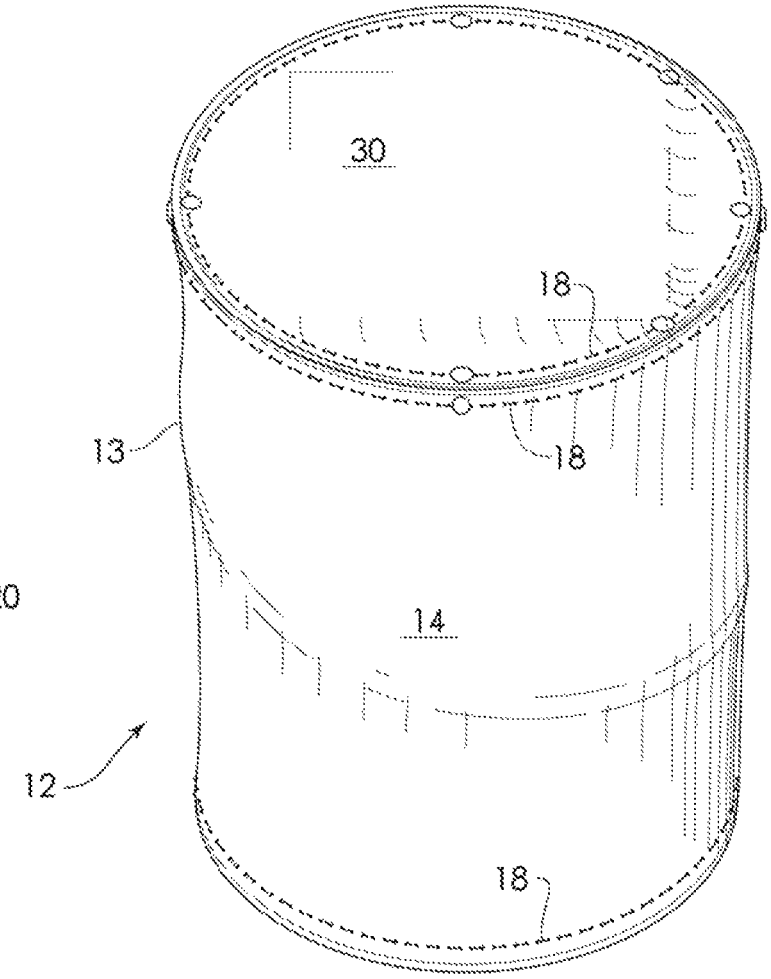
FIG. 14 is an elevated side view showing the rubbish bin blind cover 12 closed with a rubbish bin (not visible) encased within the blind 14 or lid 30 out of view.

FIGS. 13A and 13B are partial elevated views of the attachment between lid 30 and blind 14 showing the attachment therebetween in a halfway open position and in a closed position. FIG. 13A shows the lid 30 in the halfway open position, and FIG. 13B shows the lid 30 in the closed position. FIG. 13C shows how the blind 14 is attached to the rubbish bin G using strap 46 which culminates in a hook 76.

FIG. 1A is an elevated side view showing the rubbish bin blind cover closed with a rubbish bin (not visible) encased within the blind cover out of view. The diameter of the rubbish blind cover 12 is calculated from the front top corner of the rubbish bin lid L to the diagonal back corner of the handle H of the rubbish bin G. The height of the rubbish bin blind cover 12 is calculated to be the same for the rubbish bin G depending on the volume size. The volume of the rubbish bin G could be 35, 50,64, 95, and 96 gallon capacity, but mostly 35, 64, and 96 gallons. The dimensions of the rubbish bins range from 24" to 38" L×19" to 30" W×37" to 46" H. The rubbish blind cover 12 is placed over the rubbish bin G and is right up against the four corners.

The material composition of the blind cover and pieces may include new, recycled, synthetics, or blends and combinations thereof. The thread used to sew the seams and other parts together may be made of materials like PTFE, polyester, monofilament, or nylon. The materials used are designed to withstand harsh weather conditions including temperature extremes, rain, snow, UV rays, and/or mildew resistant. The wires are preferably coated, painted, or otherwise treated to reduce damage due to exposure to the elements, and as to not damage material of the body 14 and 30 over time. Coated wire which is three sixteenth (3/16) an inch is preferred.

Plastic or metal materials are preferred, or specialty cloth, weather resistant fibers may also be used. The rubbish blind cover 12 can be composed of a multitude of mixed and matched material colors, or patterns. A digital image and or screen-printed image may be used. Examples include camouflage patterns, plaid patterns, tartan patterns, gingham patterns, checkered patterns, and house patterns (such as brick, block, and siding), buildings, scenery, plants, animals, sports teams' logo emblems, and team colors.

FIGS. 15-42 are cutaway views of the rubbish blind cover body 14 showing alternative fasteners 20, 36, and 38, and straps 42, 44, and 46. Optional fasteners 20, 36, and 38, and straps 42, 44, and 46 include hooks 76, loops 64, ties 70, hook and loop strips 68 and 69, buttons 62, snaps 90 and 92, screw 114 and bolt 116, O-rings 120, cinch buckle 130, magnets 100, snapping buckles 104 and 106, hook 76 and loop 64, zippers 98, knot 67 and loop 64, quick link 82 and strap loop 78, snap hook 80 (aka carabiner) and D-ring 86, hook-eye closures 76 and 102, lobster clasp 84, hook 68 and snap clasps 94 and 96, hole 88 and button 62, button 62 and loop 64, toggle button 118, pressure clasps 122 and 124, spring clasp 84, mating clasps 72 and 74, or combinations thereof, or the like. Sturdier fasteners include cinch buckle 65 and 66, key snapping buckles 108 and 110, open snapping buckles 112 and 110, hook 76 and D-rings 86, may be desirable to accommodate the motion of opening and closing of the rubbish blind cover lid 30 (disposed on the rubbish bin lid L) relative to the attached cylindrical blind 14.

Figure 15:
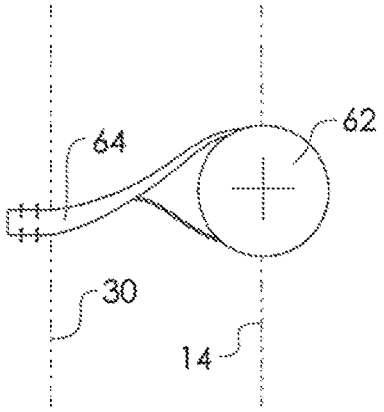
FIGS. 15-51 are cutaway views of the rubbish blind cover body 14 showing alternative fasteners 20, 36, 38.
Figure 16:
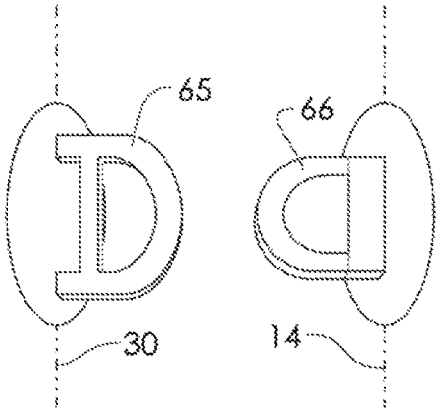
Figure 17:
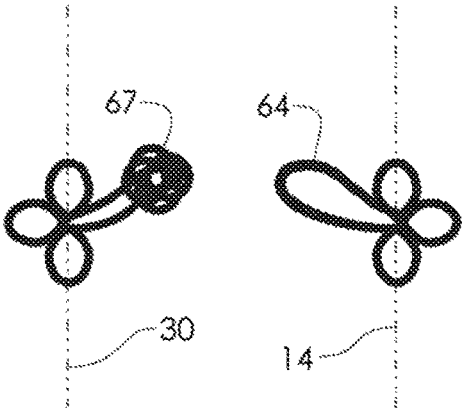
Figure 18:
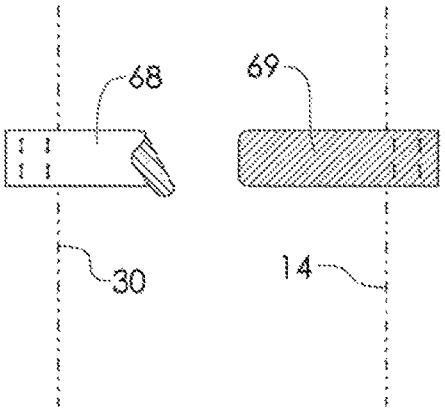
Figure 19:
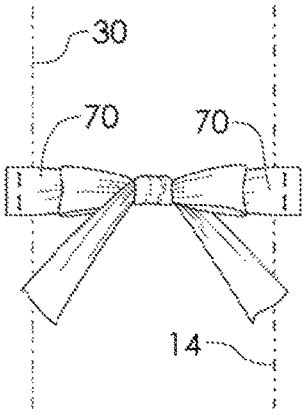
Figure 20:
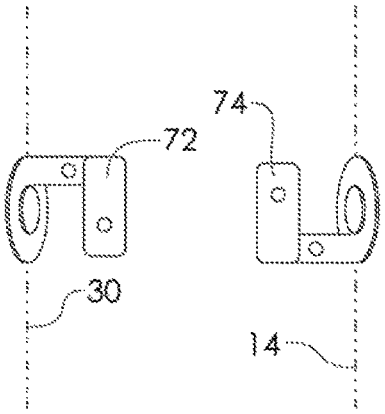
Figure 21:
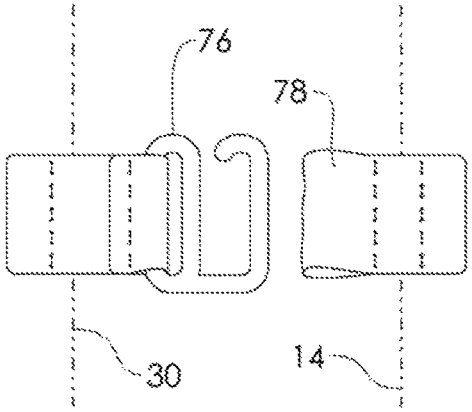
Figure 22:
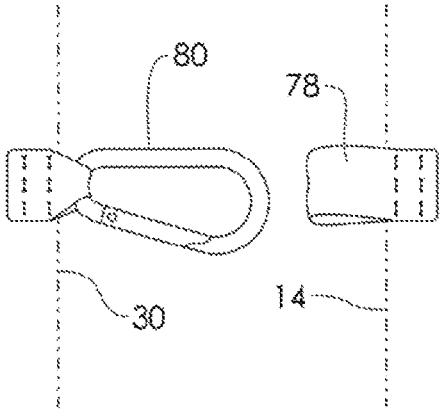
Figure 23:
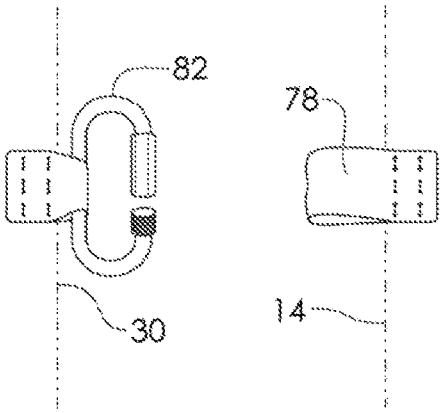
Figure 24:
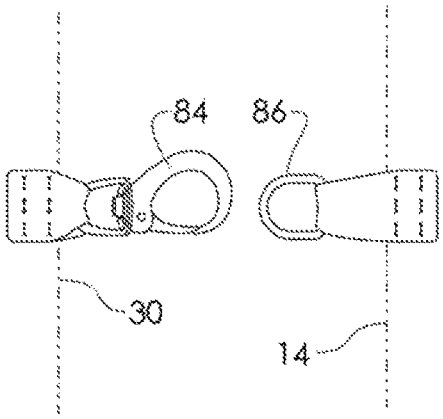
Figure 25:
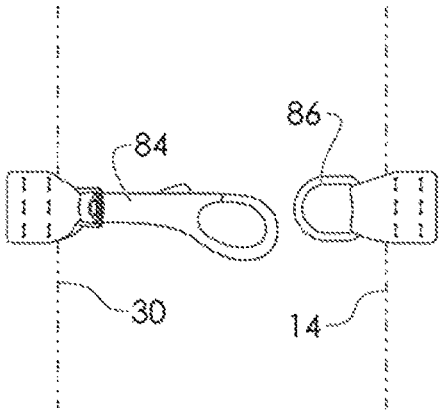
Figure 26:
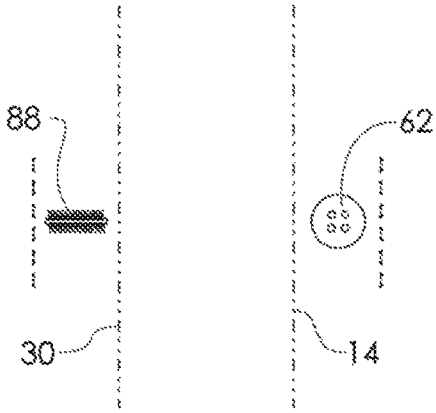
Figure 27:
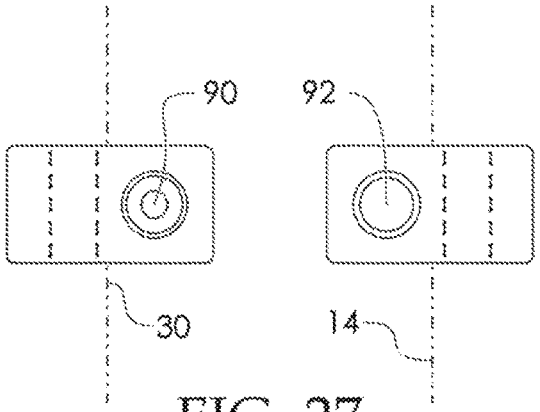
Figure 28:
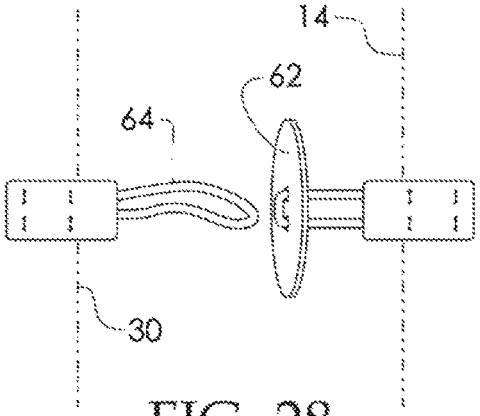
Figure 29:
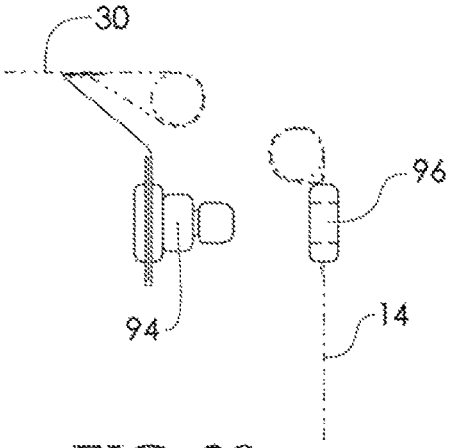
Figure 30:
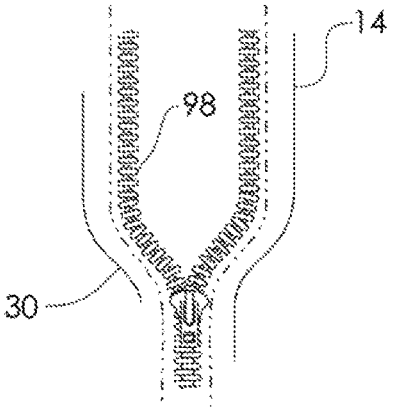
Figure 31:
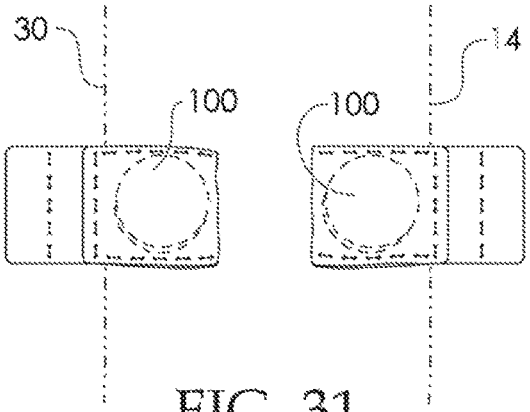
Figure 32:
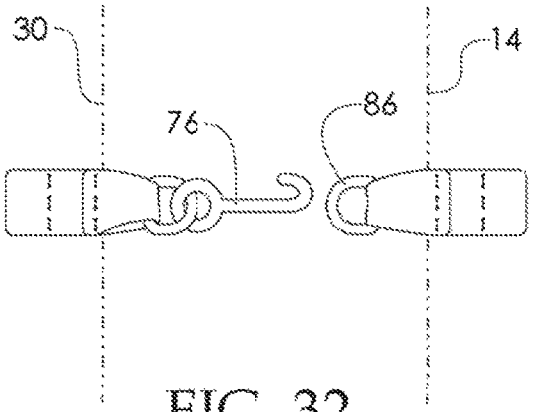
Figure 33:
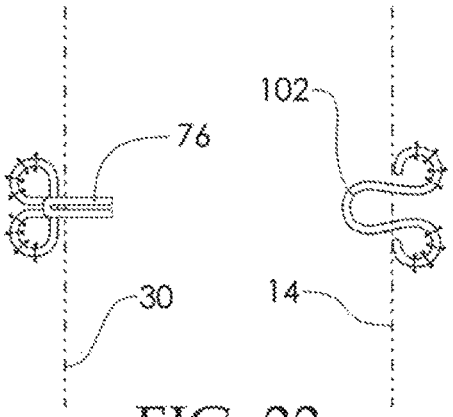
Figure 34:
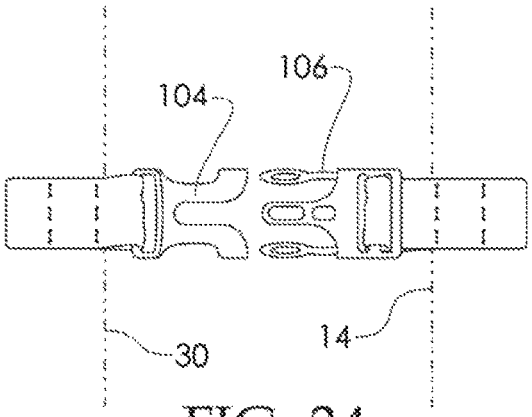
Figure 35:
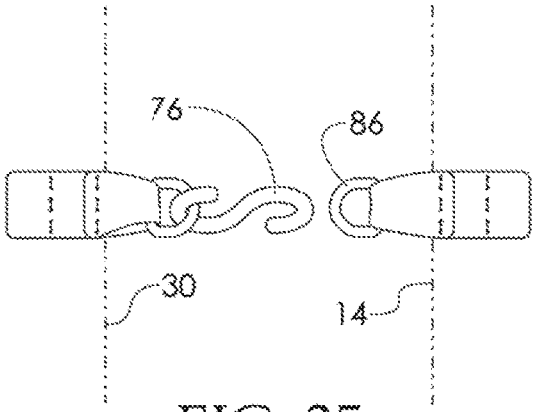
Figure 36:
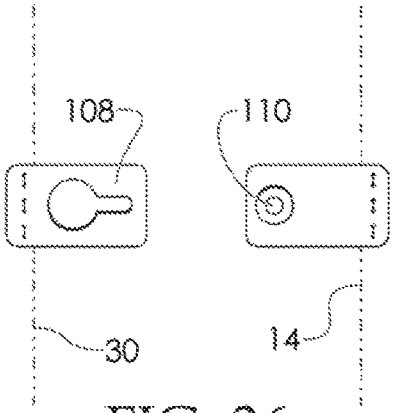
Figure 37:
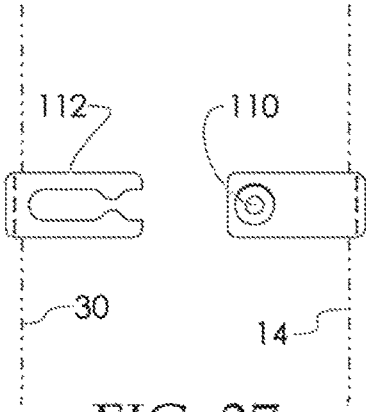
Figure 38:
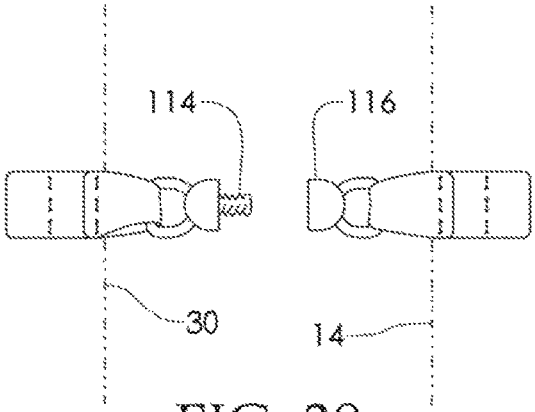
Figure 39:
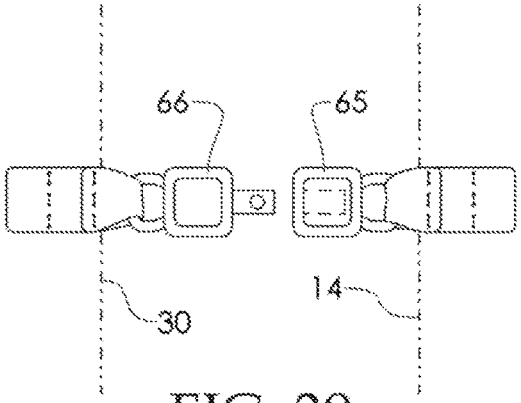
Figure 40:
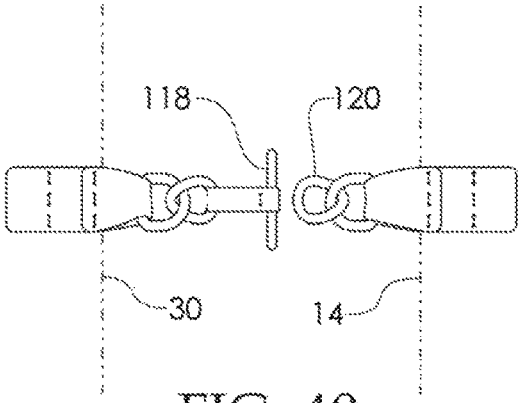
Figure 41:
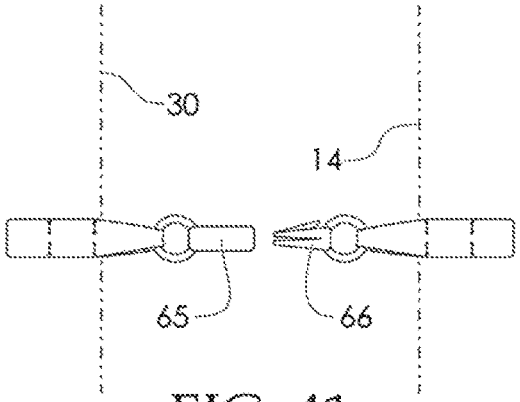
Figure 42:
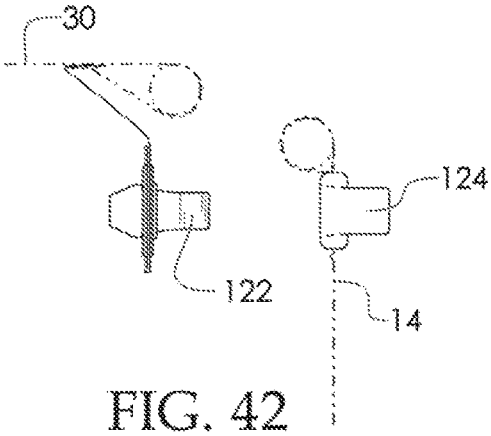
Figure 43:
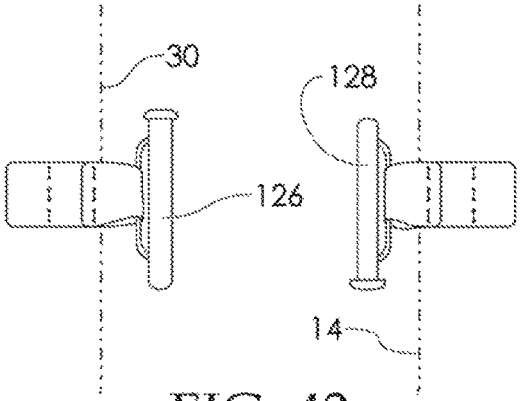
Figure 44:
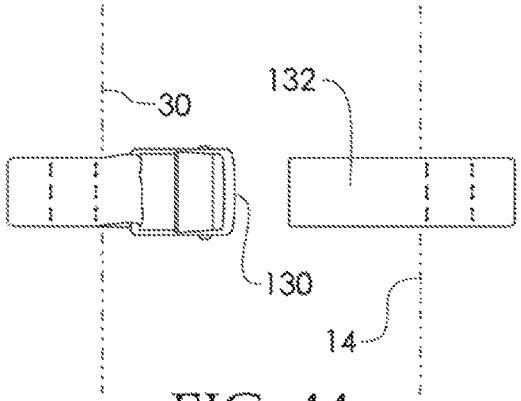
Figure 45:
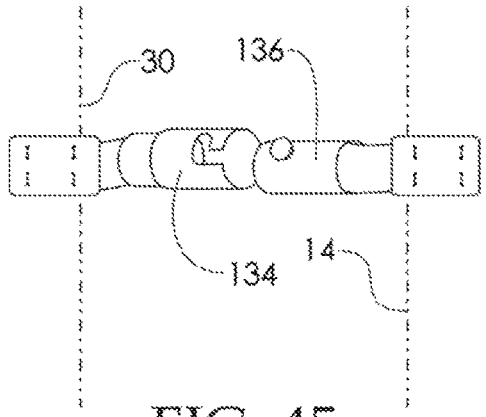
Figure 46:
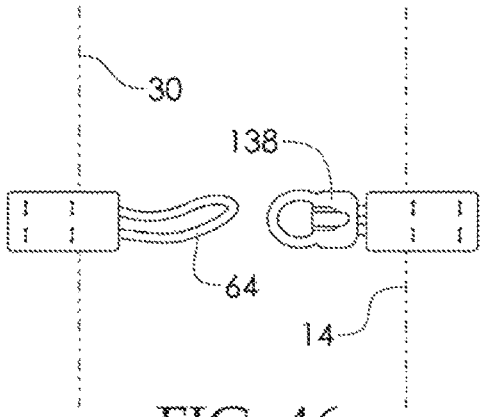
Figure 47:
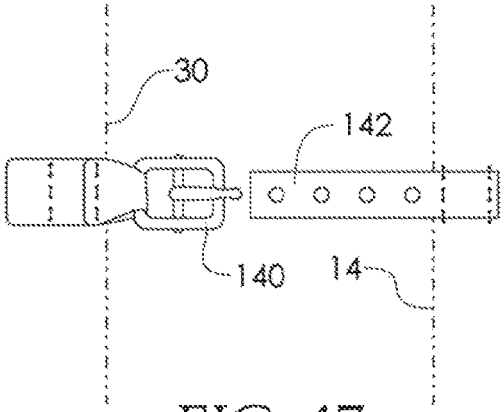
Figure 48:
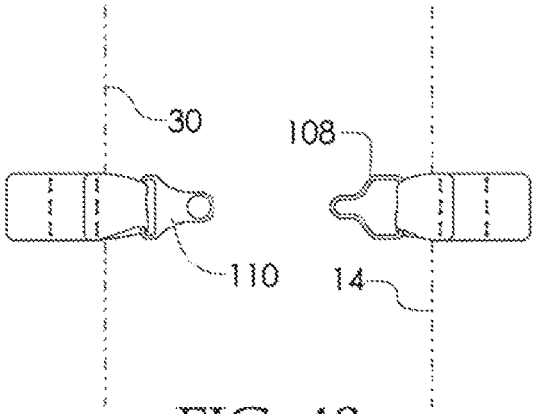
Figure 49:
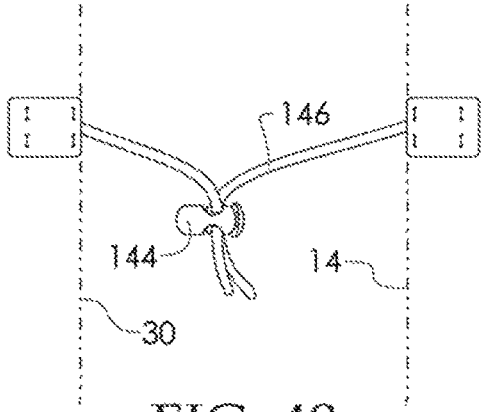
Figure 50:
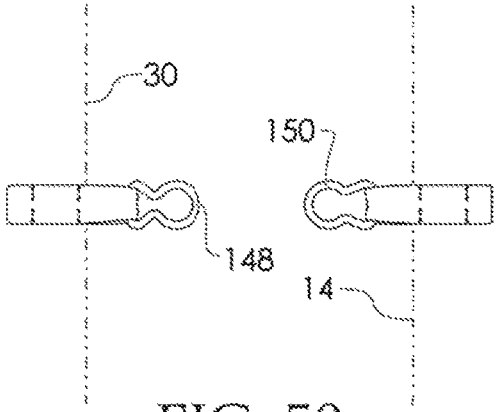
Figure 51:
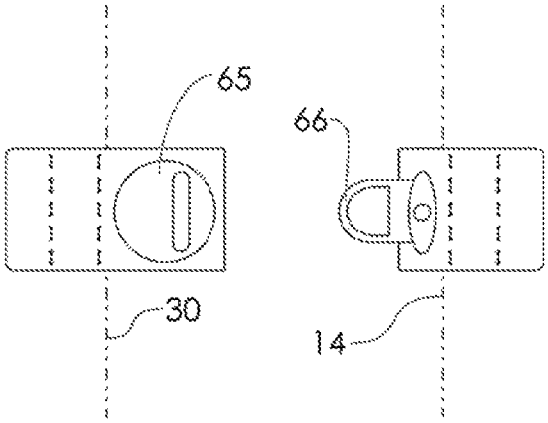

FIG. 15 shows a button 62 and loop 64 fastener 20, 36, 38, and straps 42 and 44. FIG. 16 shows a mating cinch buckle 65 and 66; similarly, FIGS. 39 and 41 has similar mating cinch buckle 65 and 66 clasps. FIG. 17 shows a knot 67 and loop 64 fastener 20, 26, 38, or 42 and 44. FIG. 18 demonstrates a hook and loop strip 68 and 69 fasteners that may be used. FIG. 19 shows tie fasteners 70, and FIG. 20 shows mating clasps 72 and 74. Various hook and loop 76 and 78 may be selected such as FIG. 21, or alternatively, a hook 76 or an S-hook may be used with a D-ring 86 may be used, as shown in FIGS. 32 and 35. A carbineer 80 or quick link 82 may be combined with a strap loop 78 and shown in FIG. 22 or 23, respectively. A lobster clasp and D-ring 84 and 86 were subjects of FIGS. 24 and 25. FIG. 26 shows simply a button 62 and button hole 88 version. FIG. 27 shows a snap fastener 90 and 92. FIG. 28 shows a button 62 and loop 64. Snap clasps 94 and 96 are shown in FIG. 29. A zipper 98 is shown in FIG. 30, and magnets 100 in FIG. 31. Eye 102 hook 76 fasteners are shown in FIG. 33. A snapping buckles 104 and 106 are shown in FIG. 34. FIGS. 36 and 37 show key snapping buckles 108 and 110, and open snapping buckles 112 and 110, respectively. A possible screw 114 and bolt 116 design is shown in FIG. 38. FIG. 40 shows a toggle button 118 and O-ring 120. FIG. 42 shows a pressure clasp 122 and 124. FIG. 43 shows a slide lock clasp in which first and second slide sections 126 and 128 interlace to form a secure attachment. FIG. 44 shows a pressure buckle 130 and strap 132 in which the strap 132 is fed through the buckle 130 and pressure on the attachment secures the strap 132 from sliding out of the buckle 130. FIG. 45 shows a magnetic lock clasp with a keyway 134 and key 136 that fit together to secure the attachment. FIG. 46 shows another loop 64 fastener which has a loop 64 and a circle-hook clasp 138 that provide a secure attachment. FIG. 47 shows a conventional buckle 140 and holed strap 142. FIG. 48 shows a button 110 and metal hook 108. FIG. 49 shows a spring-loaded cord stopper 144 on a cord 146. FIG. 50 shows an interlocking circle clasp having first and second 148 and 150 matting parts. FIG. 51 is an additional slide lock quick release made up of a cinch buckle 65 and a clasp 66. Various combinations of these fasteners may be utilized to provide sturdy attachments.

It is to be understood that the present invention is not limited to the embodiments described above, but encompasses any and all embodiments within the scope of the following claims.

What is claimed is:

1. A rubbish bin blind cover, comprising:

a blind cover body 14 and a blind cover lid;

the blind cover lid having lid straps that crisscross;

the blind cover body having a hollow cylindrical form with a top periphery and a wire frame;

the top periphery having at least two top periphery straps extending from opposite sides of the blind cover body; and further comprising, two handle straps configured to hook together onto a handle of a rubbish bin, and a top lip strap with a fastener to hook onto a top lip of the rubbish bin.

2. The rubbish bin blind cover of claim 1, further comprising:

a wire in the blind cover lid for structure.

3. The rubbish bin blind cover of claim 1, wherein:

the wire fame is a spiraling wire that has top and bottom loops, and a diagonal length which is placed within the blind cover body between top and bottom circles so that the wire is continuous throughout the blind cover body.

4. The rubbish bin blind cover of claim 3, wherein:

the wire of the wire frame is coated, painted, or combinations thereof.

5. The rubbish bin blind cover of claim 3, further comprising:

tabs positioned along the diagonal length to retain the wire frame in place.

6. The rubbish bin blind cover of claim 1, wherein:

the blind cover lid has substantially the same circumference as cylindrical blind and the wire within the cylindrical blind.

7. The rubbish bin blind cover of claim 6, wherein:

the lid and in the perimeter of the top of the rubbish bin aligned cover cylinder has an opening or attachments in each ⅛ section, such that they are evenly distributed around the peripheral of the lid and the top of the cylinder.

8. The rubbish bin blind cover of claim 6, further comprising:

body to lid corresponding fasteners, lined up to attach the blind body to the blind cover lid, once the crisscrossing lid straps are connected over top of the blind cover lid with crisscrossing lid strap corresponding fasteners attached, respectively; wherein the body to lid corresponding fasteners are on the top of the rubbish blind body and along the periphery of the blind cover lid.

9. The rubbish bin blind cover of claim 8, wherein:

the corresponding fasteners include fastener straps, hooks, loops, ties, hook and loop strips, buttons, snaps, screws, bolts, O-rings, buckles, magnets, zippers, knots, quick links, d-rings, hook-eye closures, lobster clasps, snap clasps, holes, loop, toggle buttons, pressure clasps, spring clasps, mating clasps, S-hooks, carbineers, quick links, holed fastener straps, spring loaded cord stoppers on cords, matting parts, slide locks, and various combinations thereof.

10. The rubbish bin blind cover of claim 1, wherein:

the blind cover is composed of new materials, recycled materials, synthetic materials, or blends or combinations thereof; or thread used may be made of PTFE, polyester, monofilament, nylon, or blends or combinations thereof; or combinations thereof.

11. The rubbish bin blind cover of claim 1, further comprising:

multiple mixed and matched material colors or patterns, digital image, screen-printed image, camouflage patterns, plaid patterns, tartan patterns, gingham patterns, checkered patterns, and house patterns (brick, block, or siding), buildings, scenery, plants, animals, sports teams' logos emblems, team colors, or combinations thereof.

12. A rubbish bin blind cover, comprising:

a blind cover body and a blind cover lid;

the blind cover lid having lid straps that crisscross;

the blind cover body having a hollow cylindrical form with a top periphery and a wire frame;

the top periphery having at least two top periphery straps extending from opposite sides of the blind cover body;

two handle straps configured to hook together onto a handle of a rubbish bin, and a top lip strap with a fastener to hook onto a top lip of the rubbish bin; and a wire in the blind cover lid for structure.

13. The rubbish bin blind cover of claim 12, wherein:

the wire fame is a spiraling wire that has top and bottom loops, and a diagonal length which is placed within the blind cover body between top and bottom circles so that the wire is continuous throughout the blind cover body.

14. The rubbish bin blind cover of claim 13, wherein:

the wire of the wire frame is coated, painted, or combinations thereof.

15. The rubbish bin blind cover of claim 14, further comprising:

tabs positioned along the diagonal length to retain the wire frame in place.

16. The rubbish bin blind cover of claim 12, wherein:

the blind cover is composed of new, recycled, synthetic, or blends or combinations thereof.

17. The rubbish bin blind cover of claim 12, wherein:

thread used may be made of PTFE, polyester, monofilament, nylon, or blends or combinations thereof; or combinations thereof.

18. The rubbish bin blind cover of claim 12, further comprising:

multiple mixed and matched material colors or patterns, digital image, screen-printed image, camouflage patterns, plaid patterns, tartan patterns, gingham patterns, checkered patterns, and house patterns, buildings, scenery, plants, animals, sports teams' logos emblems, team colors, or combinations thereof.

19. The rubbish bin blind cover of claim 18, wherein:

the house patterns include brick, block, or siding, or combinations thereof.

* * * * *